United States Patent [19]

Marks

[11] 4,148,541

[45] Apr. 10, 1979

[54] INTERLOCKING ELECTRON TUBE BASE AND ADAPTER

[75] Inventor: Bruce G. Marks, Lancaster, Pa.

[73] Assignee: RCA Corporation, New York, N.Y.

[21] Appl. No.: 859,857

[22] Filed: Dec. 12, 1977

Related U.S. Application Data

[63] Continuation-in-part of Ser. No. 838,717, Oct. 3, 1977, abandoned.

[51] Int. Cl.[2] ..... H01R 13/48

[52] U.S. Cl. ..... 339/144 T; 313/318; 339/75 T

[58] Field of Search ..... 339/144 T, 145 T, 75 T; 313/318, 325

[56] References Cited

U.S. PATENT DOCUMENTS

| | | | |
|---|---|---|---|
| 3,636,412 | 1/1972 | Simouits | 339/111 X |
| 3,869,633 | 3/1975 | Dumas et al. | 313/318 X |
| 4,054,346 | 10/1977 | Schultz | 339/145 T X |

*Primary Examiner*—Roy Lake

*Assistant Examiner*—E. F. Desmond

*Attorney, Agent, or Firm*—E. M. Whitacre; G. H. Bruestle

[57] ABSTRACT

A wafer type tube base is secured to a stem structure of an electron tube. The base includes a cup which fits over an exhaust tubulation of the stem and a wafer flange which extends radially outward from the open end of the cup and abuts the stem wall. The flange has an array of apertures for receiving an array of stem conductors therethrough. An adapter is provided for converting the wafer-type base to a pin-protector type base. The adapter comprises a hollow cylindrical member having a plurality of longitudinally extending ribs on its outer surface. The adapter telescopes over the exhaust tubulation cup and receives the stem conductors in the grooves between the ribs. Means for interlocking the adapter to the wafer base comprises a pair of openings in the cylindrical wall of the cup and a pair of inwardly projecting fingers at an end of the adapter which are adapted to be received in the openings and are sized to engage the cup wall in a frictional snap fit.

8 Claims, 5 Drawing Figures

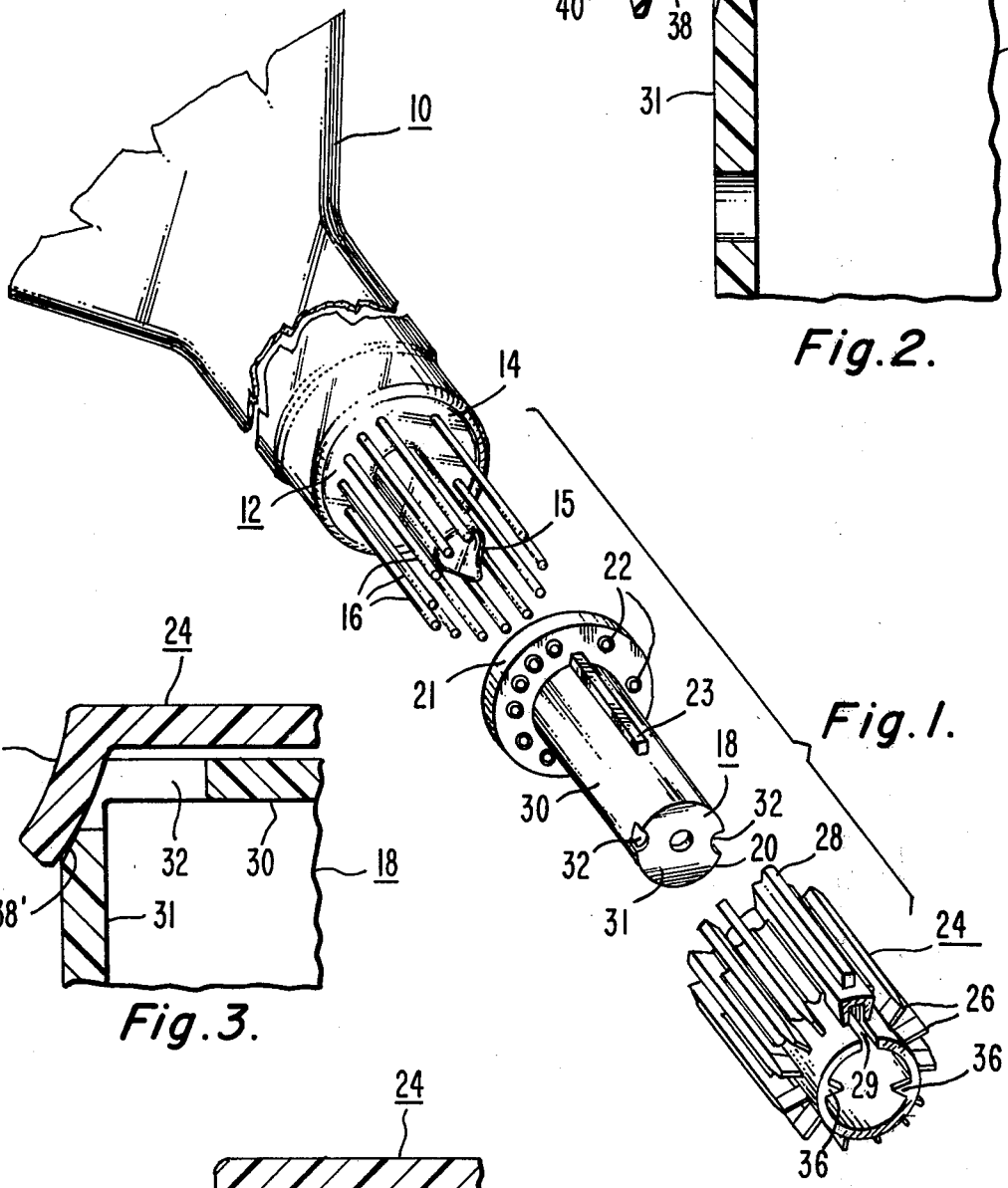
Fig. 1.
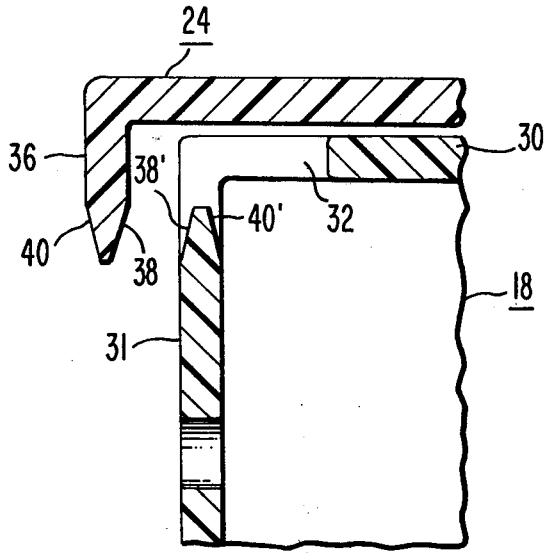
Fig. 2.
Fig. 3.
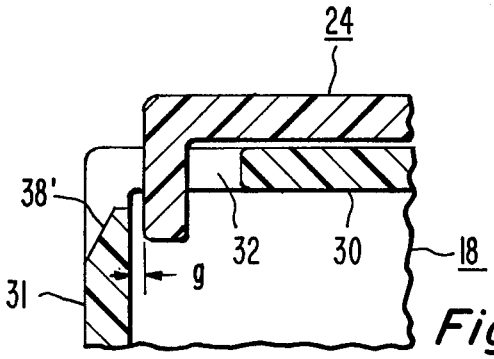
Fig. 4.

INTERLOCKING ELECTRON TUBE BASE AND ADAPTER

This is a continuation-in-part of application Ser. No. 838,717, filed Oct. 3, 1977, now abandoned.

BACKGROUND OF THE INVENTION

This invention relates to bases for electron tubes, e.g. color picture tubes, and particularly to a base and an adapter therefor which permits simple conversion from one type of base to another type of base.

Certain types of electron tubes, e.g. color picture tubes, include a stem structure comprising a glass wafer, a circular array of stiff lead-in conductors sealed through the wafer, and a central opening through the wafer from which an exhaust tubulation extends. It is common practice to attach a base member, usually of some type of plastic material, over the lead-in conductors and exhaust tubulation. The base member serves to protect the lead-in conductors and the exhaust tubulation, and to provide an indexing means for insertion into a mating socket. Two types of bases which are commonly employed in the picture tube industry are those known as wafer bases and pin-protector bases.

Wafer bases, as employed in present day picture tubes, are disclosed, for example, in U.S. Pat. No. 2,498,378 issued to G. N. Phelps on Feb. 21, 1950 and in U.S. Pat. No. 3,278,886 issued to H. H. Blumenberg et al on Oct. 11, 1966. Such bases comprise a protector cup disposed over the exhaust tubulation of an electron tube stem, and a wafer flange which extends radially outwardly from the open end of the cup. The flange is abutted against the tube stem and is provided with an array of apertures through which the lead-in conductors of the stem are disposed. The Blumenberg et al patent additionally discloses a separate tubular silo extending from the flange alongside the cup for receiving one of the stem conductors thereon for high voltage insulation purposes. In these bases the lead-in conductors are spaced outwardly from the exhaust tubulation protector cup of the base, and are thus free-standing once they pass through the wafer flange of the base.

A pin-protector base, as employed in present-day picture tubes, is disclosed, for example, in U.S. Pat. No. 3,979,157 issued to L. J. Dimattio on Sept. 7, 1976. The pin-protector base is a modification of the wafer base in that the exhaust tubulation protective cup is provided with a plurality of longitudinal ribs along its outer cylindrical surface, and is enlarged so that the lead-in conductors lie protected in channel-like recesses of the base. The lead-in conductors of a pin-protector base are not free standing but instead lie in flush contact along the outer surface of the protector cup.

A manufacturer of electron tubes may wish to fabricate both wafer base tubes and pin-protector base tubes using the same tube processing equipment on his production line. To do so, processing sockets are provided which accommodate the larger pin-protector bases. When a tube having a wafer base is to be processed, an adapter is placed over the wafer base to convert it to a pin-protector base which can be properly received within the socket. Such an adapter is disclosed, for example, in U.S. Pat. No. 3,771,105 issued to E. Yamazaki et al on Nov. 6, 1973.

Where such adapters have been employed in the past, they have simply involved a suitable sleeve which is slipped over the wafer type base. In some instances the adapter sleeves are held on sufficiently snuggly by frictional engagement while at other times, due to a loose fit because of manufacturing tolerances, they fall off in normal handling of the tube along the production line. In the latter instances difficulties resulting in down time of the production line result.

SUMMARY OF THE INVENTION

A novel wafer base and a novel adapter sleeve for converting the base to a pin-protector base is provided with interlocking means to prevent accidental removal of the adapter sleeve from the base. The interlocking means comprises a pair of openings in the cylindrical wall of the exhaust tubulation protector cup of the base. The adapter sleeve includes a pair of fingers which project radially inwardly into the apertures in a snap type frictional engagement.

BRIEF DESCRIPTION OF THE DRAWINGS

FIG. 1 is an exploded perspective showing one embodiment of the novel wafer base aligned for attachment to a stem of an electron tube, and the novel adapter sleeve aligned with the base for telescoping thereon.

FIGS. 2–4 are enlarged sections of portions of the base and adapter showing details thereof.

DESCRIPTION OF THE PREFERRED EMBODIMENT

Figure 5:
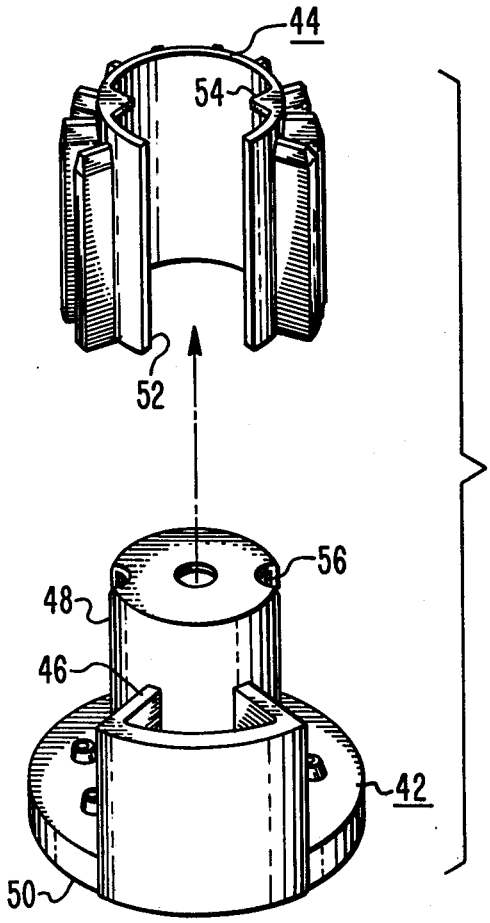
FIG. 5 is a perspective of a modification of the base and adapter of FIG. 1.

In FIG. 1, a broken away portion of a cathode ray picture tube 10 is shown to include a stem structure 12 comprising an end wall 14 of a tubular neck section of the tube through which a circular array of parallel conductors 16 are sealed. The stem 12 also includes an aperture in the wall 14 and an exhaust tubulation 15 which is disposed over the aperture centrally within the array of conductors 16.

A novel wafer base 18 is adapted to be disposed over the exhaust tubulation 15 and lead-in conductors 16 of the stem 12. The base 18 is of the general type disclosed in U.S. Pat. No. 2,498,378-Phelps, which patent is incorporated herein by reference for purposes of disclosure. The base 18 includes a hollow cylindrical exhaust tubulation protective cup 20 and a wafer flange 21 extending radially outwardly from the open end of the cup 20. The flange 21 is provided with an array of apertures 22 through which the conductors 16 can be received. In mounting the base 18 to the stem 12, the flange 21 is seated flush against the end wall 14 with the exhaust tubulation 15 disposed within the cup 20 and the conductors 16 extending through the apertures 22. That portion of each conductor 16 which extends beyond the wafer flange 22 is free standing and spaced radially outward from the cylindrical wall of the tubulation cup 20.

A ridge or key 23 extends longitudinally along a portion of the length of the protector cup 20 for purposes of indexing the base 18 in a suitable socket as is well known in the art.

A novel adapter 24 is provided which can be telescoped over the tubulation protection cup 20 to convert the wafer base 18 to a pin-protector base. A typical pin-protector base is disclosed in U.S. Pat. No. 3,979,157-Dimattio. The adapter 24 is of the general type disclosed in U.S. Pat. No. 3,771,105-Yamazaki et al. These two patents are incorporated herein by reference for purposes of disclosure.

The novel adapter 24 comprises a hollow cylindrical sleeve having an inside diameter slightly larger than the exterior diameter of the tubulation protector cup 20 of the wafer base 18. The outer cylindrical surface of the adapter 24 is provided with an array of outwardly extending ribs 26 and a key 28 for indexing purposes within an appropriate socket. The interior cylindrical surface of the adapter 24 is provided with a goove 29 into which the key 23 of the wafer base 18 is received. When the sleeve 24 is telescoped over the cup 20, the conductors 16 are disposed between the ribs 26 flush against the outer cylindrical surface of the adapter 24.

The wall of the cup 20 comprises a cylindrical portion 30 and a flat end portion 31. In order to provide an interlocking relationship between the base 18 and the adapter 24, the cylindrical wall 30 is provided with a pair of openings 32 therein. These openings are preferably disposed, as shown, at the closed end of the cup at the edge between the cylindrical wall 30 and the flat end wall 31 so that they extend slightly into the end wall 31.

The adapter 24 is provided with a pair of inwardly extending fingers 36 at one end thereof. The fingers 36 are so positioned and sized that when the adapter 24 is telescoped over the cup 20 the fingers will frictionally pass over an edge of the cup wall in a snap-like action and be received in the openings 32. Thus, the adapter 24 is held securely onto the wafer base 18 by the engagement of the fingers 36 with the cup wall, but may be removed by a suitable force. Such force for removal of the adapter from the base 18 may be established in the design of the adapter 24 by selectively sizing the fingers 36. A removal force of about 8 pounds (3.63 kilograms) has been found to be preferred.

The openings 32 may be spaced from the end wall 31 down along the cylindrical wall 30 at any desired location. However, this has the disadvantage of possible interference by the exhaust tabulation 15 with the adapter fingers when they snap into the base openings. Furthermore, the fingers must then be formed on the internal cylindrical surface of the adapter 24, e.g. as short bosses. With such short fingers it has proved difficult to obtain a controllable insertion and removal force of the base and adapter with ordinary manufacturing tolerances.

Accordingly, it is preferred that the openings 32 be located at the end of the cylindrical wall 30 and extend into the end wall 31, so that the snap-action engagement of the fingers 36 is with the end wall 31 rather than with the cylindrical wall 30. Such an embodiment, as shown in FIG. 1, is preferred because it permits spacing the finger-engaging edge of the opening 32 farther away from the adapter 24 (by extending the openings 32 into the end wall 31) and making the fingers 36 longer than would otherwise be possible. Making the fingers 36 longer provides them with greater flexibility. This in turn results in more accurate setting of the snap-on and snap-off forces through size design of parts using ordinary manufacturing techniques.

FIG. 2 is an enlarged sectional view showing a refinement in the design of the opening 32 and finger 36 which even further enhances the controllability of the snap-on action. As shown in FIG. 2, the finger 36 and the end wall 31 are provided with snap-on bevels 38 and 38', respectively, and snap-off bevels 40 and 40', respectively.

The snap-on bevels 38 and 38' result in an easier snap-on force when the base 18 is inserted into the adapter 24. The amount of slope of the bevels 38 and 38' determines the degree of force required for the snap-on action. Similarly, the snap-off bevels 40 and 40' facilitate removal of the adapter sleeve 24 from the base 18, and the degree of slope of these bevels determines the amount of force required for removal.

For illustrative purposes, the embodiment shown in FIG. 2 is provided with all four bevels 38, 38', 40 and 40'. However, in actual practice, either all four or fewer bevels may be provided. In a preferred practice, it has been found that provision of the snap-on bevel 38' on the end wall 31 produces the optimum snap-on and snap-off action. Such a construction is shown in FIGS. 3 and 4. Bevels 38, 40 and 40' are therefore omitted in the preferred embodiment. This results in easier snap-on action than if no bevels at all were used, and yet maintains a higher desired snap-off force.

FIGS. 3 and 4 illustrate the preferred bevel arrangement, finger flexure, and the clearance that allows the flexed finger 36 to enter the opening 32 during the snap-on action.

FIG. 3 shows that as the adapter 24 is telescoped onto the base 18, the snap-on bevel 38' contacts the finger 36 and flexes the finger to the left. FIG. 4 shows that in order for the finger to clear the edge of the end wall 31 and snap into place in the opening 32, the length of the base cup 20 must exceed the length of the adapter by a distance sufficient to allow for the flexure of the finger. In one embodiment it has been found that a gap length "g" of 0.030 inch (0.76 mm) when the adapter 24 is bottomed against the base flange 21 is satisfactory to accommodate the flexure of the finger during the snap-on action.

Referring again to FIG. 1, the key 23 of the base 18 is shown to extend only part way along the cylindrical wall 30 of the cup 20. As is well known, this allows a blind indexing of the base 18 into a mating socket, or similarly into the adapter 24. The adapter 24 can be fitted over the end cylindrical section of the cup 20 and rotated until the key 23 falls into the groove 29 in the adapter 24. For this purpose it is necessary that the groove 29 extend only part way along the length of the adapter 24. However, in a preferred embodiment of the novel adapter 24, the groove 29 is continued throughout the entire length of the adapter. This results in a desired weakening of the adapter 24 such that an operator may compress it into an out-of-round shape by mere finger pressure. When this pressure is properly applied, it can result in spreading apart the tips of the fingers 36 to more easily release the adapter 24 from the base 18.

FIG. 5 illustrates a base 42 and an adapter 44 which are modifications of the base and adapter of FIG. 1. The base 42 is of the general type disclosed in U.S. Pat. No. 3,278,886-Blumenberg et al, which patent is incorporated herein by reference for purposes of disclosure.

The base 42 differs from the base 18 of FIG. 1 primarily in that it further includes a tubular silo 46. The base 42 comprises a hollow cylindrical exhaust tubulation protective cup 48 and an apertured wafer flange 50 extending radially outwardly from the open end of the cup 48. The cup 48 and flange 50 are similar to the cup 20 and flange 21 of FIG. 1 except that the cup 48 is not provided with an indexing key 23 (FIG. 1). The silo 46 extends from the flange 50 alongside and contiguous with the cup 48. The silo 46 is adapted to receive a stem conductor therein through one of the apertures in the flange 50 for high voltage insulation purposes.

The adapter 44 is similar to the adapter 24 of FIG. 1 except that in the place of the external key 28 (FIG. 1) and internal key slot 29 (FIG. 1), the adapter 44 is provided with a wide longitudinal slot 52. The slot 52 is open completely through the cylindrical wall of the adapter 44 and is sized to receive the silo 46 when the adapter 44 is telescoped over the base 42. The silo 46 and slot 52 provide indexing between the base and adapter.

In the embodiment shown, the silo 46 does not extend the full length of the cup 48. Accordingly, for purposes of mating the adapter 44 to the base 42 the slot 52 need not extend the full length of the adapter 44. However, it is preferred that the slot 52 be extended the full length so that the ends of the adapter 44 can be spread slightly apart by a person's fingers to facilitate removal of the adapter 44 from the base 42. Furthermore, it is desirable to omit the two ribs immediately adjacent the silo 46 to make it easier for a person to insert his fingers for removal.

Snap-on interlocking of the adapter 44 to the base 42 is provided by flexible fingers 54 on the adapter which engage holes 56 in the base in exactly the same manner as described with reference to the base and adapter of FIGS. 1-4.

Both the novel wafer bases and the adapters may be made of a suitable plastic material as is well known in the art. Examples of such suitable materials are polysulfone and nylon.

I claim:

1. A wafer base for an electron tube comprising a hollow cylindrical tubulation protector cup and a flange extending radially outwardly from the open end of the cup, said flange having an array of apertures for receiving therethrough an array of conductors of said tube, and said cup having a pair of openings in the cylindrical wall thereof for receiving therein a pair of mating fingers of a base conversion adapter.

2. The base of claim 1 wherein said openings are disposed at the closed end of said cup and extend into an end wall thereof.

3. The base of claim 2 wherein at least one edge of the end wall portion of each of said openings is beveled.

4. The base of claim 1 which further comprises a tubular silo extending from said flange alongside and contiguous with said cylindrical cup, and wherein one of said conductors is disposed within said silo.

5. The combination of a wafer base for an electron tube and an adapter for converting said wafer base to a pin-protector base, said wafer base comprising a hollow cylindrical cup and a wafer flange extending radially outward from the open end of said cup, said cup being adapted to receive an exhaust tubulation of said tube therein and said flange having an array of apertures therein for receiving an array of conductors of said tube therethrough, said adapter comprising a hollow cylindrical sleeve adapted to telescope over said cup and having a plurality of longitudinal ribs on the outer cylindrical surface thereof adapted to be disposed between adjacent ones of said conductors when said adapter is telescoped over said cup, and means for interlocking said adapter to said base comprising a pair of openings in the cylindrical wall of said cup and a pair of fingers extending inwardly from said adapter into said openings and engaging the wall of said cup in a frictional snap action.

6. The base-adapter combination of claim 5 wherein said base has a longitudinal key on the external cylindrical surface of said cup and said adapter has a longitudinal groove in the interior cylindrical surface thereof which mates with said key and which extends the entire length of said adapter, whereby to permit easy compression of said adapter sleeve for easy removal thereof from said base.

7. The base-adapter combination of claim 5 wherein at least one of said adapter fingers and the finger-engaged wall of said base is beveled to modify the force required for interlocking engagement or disengagement of said adapter and base.

8. The base-adapter combination of claim 5 wherein said base further comprises a tubular silo extending from said flange alongside and contiguous with said cylindrical cup, and wherein one of said conductors is disposed within said silo, and wherein said adapter has an open longitudinal slot therein for receiving said silo when said adapter is telescoped over said cup.

* * * * *